United States Patent [19]

Kagoura

[11] 4,121,864

[45] Oct. 24, 1978

[54] LATCH ASSEMBLY

[75] Inventor: Tetsuro Kagoura, Kurobe, Japan

[73] Assignee: Yoshida Kogyo K.K., Tokyo, Japan

[21] Appl. No.: 782,518

[22] Filed: Mar. 29, 1977

[30] Foreign Application Priority Data

Apr. 3, 1976 [JP] Japan ..... 51-41105[U]

[51] Int. Cl.[2] ..... E05C 13/00

[52] U.S. Cl. ..... 292/202; 292/336.3

[58] Field of Search ..... 292/207, 208, 347, 336.3, 292/358, DIG. 27, 202

[56] References Cited

U.S. PATENT DOCUMENTS

| | | | |
|---|---|---|---|
| 1,236,881 | 8/1917 | Schalow | 292/359 X |
| 1,783,785 | 12/1930 | Habicht | 292/359 |
| 3,025,096 | 3/1962 | Williams | 292/359 |

*Primary Examiner*—Richard E. Moore

*Attorney, Agent, or Firm*—Hill, Gross, Simpson, Van Santen, Steadman, Chiara & Simpson

[57] ABSTRACT

A latch assembly comprises a bolt unit mounted in a frame member of a door or window sash, and a bolt-driving unit installed on one side of the door or window sash. The bolt unit has a latch bolt supported by a rotatable and axially movable shaft, the bolt being pivotable between projecting and retracted positions by rotation of the shaft. The bolt driving unit includes an axially movable driver torque bar having on one end a driver that is normally disengaged from the shaft. The shaft has thereon engaging means normally held in engagement with a support frame of the bolt unit. Upon axial movement of the torque bar toward the shaft, the driver is moved out of engagement with the fixed engaging means into driving engagement with the shaft. The engaging means on the shaft is shifted out of engagement with the support frame by continued movement of the torque bar, whereupon the shaft is free to rotate about its longitudinal axis. The driver torque bar can be axially moved by a push button mounted in the handle coaxially with the torque bar.

11 Claims, 3 Drawing Figures

LATCH ASSEMBLY

BACKGROUND OF THE INVENTION

Field of the Invention

The present invention relates to a latch assembly for use on a frame member of a window sash or door.

SUMMARY OF THE INVENTION

The latch assembly of the invention includes a bolt unit having a pivotable latch bolt supported by a shaft mounted rotatably in a support frame to be installed in a window sash or door frame member, and a bolt-driving unit having a casing to be attached to the frame member, an operator handle having a cylinder shaft disposed rotatably in the casing, and a driver torque bar having one end mounted coaxially in the cylinder shaft for corotation therewith and axial movement therein. The shaft has engaging means for engagement with the support frame for retaining the shaft against rotation. The driver torque bar has on the opposite end a driver that is normally held in engagement with fixed engaging means on the casing against rotation of the torque bar. Upon axial movement of the torque bar toward the shaft, the driver is shifted out of engagement with the fixed engaging means into driving engagement with the shaft. Continued movement of the torque bar causes the engaging means on the shaft to shift out of engagement with the support frame, whereupon the shaft becomes free to revolve about its own axis. When the handle is manipulated to pivot about the cylinder shaft, the driver torque bar rotates the shaft about its longitudinal axis, and hence the latch bolt about the shaft into or out of a projecting position. A spring-loaded push button is retained in the handle for pushing the driver torque bar toward the shaft.

Accordingly, it is an object of the present invention to provide a latch assembly having a compact mechanism.

Another object of the present invention is to provide a latch assembly comprising unitized component parts.

Another object of the present invention is to provide a latch assembly which can easily be assembled and installed.

A still further object of the present invention is to provide a latch assembly having means for retaining the operator handle and latch bolt positively in a latched or unlatched position.

Many other advantages and features of the present invention will become manifest to those versed in the art upon making reference to the detailed description and the accompanying sheet of drawings in which a preferred structural embodiment incorporating the principles of the present invention is shown by way of illustrative example.

DETAILED DESCRIPTION OF THE PREFERRED EMBODIMENT

Figure 1:
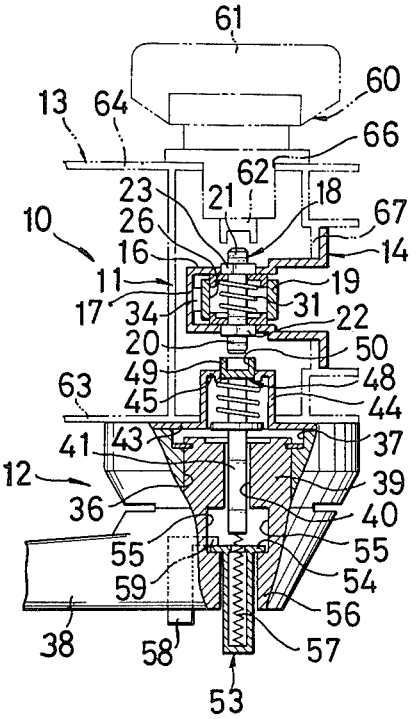
FIG. 1 is a top view, partly cut away, of a latch assembly constructed in accordance with the invention, the assembly being installed on a frame member.

The principles of the present invention are particularly useful when embodied in a latch assembly such as shown in FIG. 1, generally indicated by the numeral 10. The latch assembly 10 broadly comprises a latch bolt unit 11 and a bolt-driving unit 12, the units when assembled together being installed, for example, on a vertical frame member or stile 13 of a swinging window sash or door.

Figure 2:
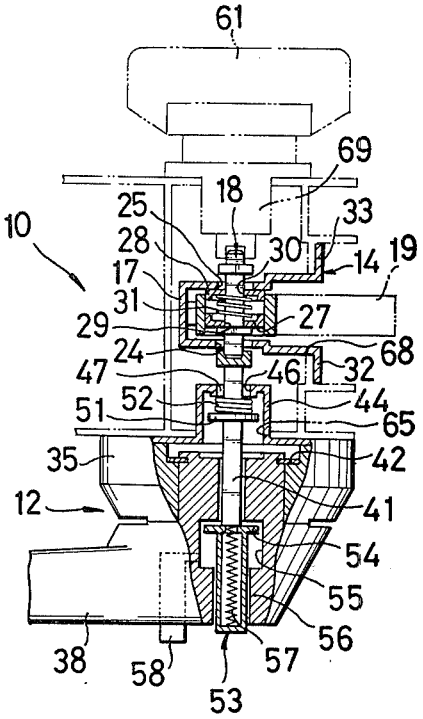
FIG. 2 is a view similar to FIG. 1 but showing the parts in a position ready for actuation.
Figure 3:
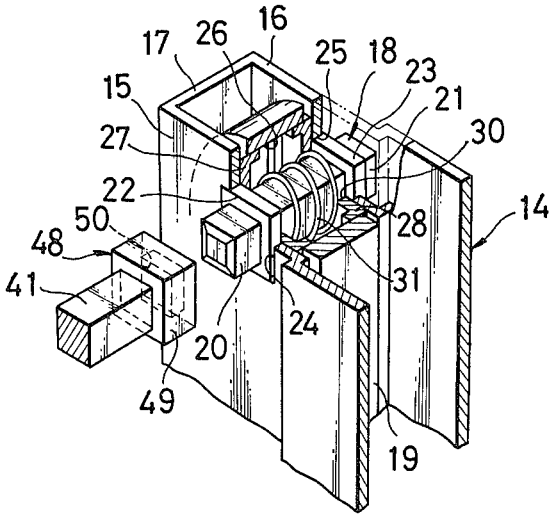
FIG. 3 is an enlarged perspective view, with parts broken away, of a central portion of the latch assembly shown in FIGS. 1 and 2.

In FIGS. 1 and 2, the latch bolt unit 11 comprises a support frame 14 of a generally channel-shaped cross-section having a pair of spaced walls 15, 16 and an end wall 17 interconnecting the spaced walls 15, 16, a shaft 18 of a square cross-section extending across and through the spaced walls 15, 16, and a latch bolt 19 mounted at one end on the shaft 18 and extending radially from the shaft 18 or in a direction substantially perpendicularly to a longitudinal axis of the shaft 18. The shaft 18 has both of its ends 20, 21 projecting beyond the spaced walls 15, 16, respectively, the shaft 18 having a pair of spaced square flanges 22, 23 which are located adjacent to the ends 20, 21, respectively, and slidably fitted in a pair of aligned square holes 24, 25, respectively, in the spaced walls 15, 16, as best shown in FIG. 3. Thus, when the flanges 22, 23 are disposed in the holes 24, 25, or in substantial alignment with the walls 15, 16, the shaft 18 is prevented from being turned about its longitudinal axis. With the shaft 18 displaced axially for disengagement of the flanges 22, 23 from the walls 15, 16, the latch bolt 19 is pivotable or angularly movable substantially 90° between a first or withdrawn position in which the bolt 19 is retracted within the support frame 14 and a second or projecting position in which the bolt 19 has the opposite free end projecting outwardly from the support frame 14, the first position being indicated by the solid lines and the second position by the imaginary lines (FIG. 2). The latch bolt 19 has a square opening 26 in which a pair of spaced square plates 27, 28 are disposed for sliding movement toward and away from each other within the opening 26, the plates 27, 28 being snugly fitted in the opening 26 for driving engagement with the latch bolt 19. The square plates 27, 28 have a pair of central square apertures 29, 30 respectively, through which the shaft 18 slidably extends, the shaft 18 being snugly fitted in the apertures 29, 30 for driving engagement with the plates 27, 28. With this arrangement, revolution of the shaft 18 causes swinging movement of the latch bolt 19 by a force transmitted through the plates 27, 28. Further, the arrangement allows the plates 27, 28 to move relatively to the shaft 18 and to the bolt 19 in a direction parallel to the axis of the shaft 18. A compression coil spring 31 is disposed around the shaft 18 between the spaced plates 27, 28 and normally biases the plates 27, 28 apart into engagement with the spaced walls 15, 16, respectively. With the plates 27, 28 thus pressed resiliently against the walls 15, 16, the flanges 22, 23 are normally held in the holes 24, 25, respectively, against displacement. The spaced walls 15, 16 have a pair of attachment flanges 32, 33, respectively, located remotely from the end wall 17, the flages 32, 33 having attachment screw holes (not shown).

A flat spring 34 is mounted on the end wall 17 and acts on the latch bolt 19 for maintaining it in the first position against rattling movement or in the second position against gravity.

The bolt-driving unit 12 comprises a substantially circular casing 35 having a central bore 36 and a counterbore 37, an operator handle 38 having on one end a cylinder shaft 39 rotatably disposed in the bore 36 and a central slot 40 of a square cross-section defined coaxially in the shaft 39, and a driver torque bar or spindle 41 of a square cross-section having one end axially slidably received in the slot 40, the torque bar 41 being fitted in the slot 40 for corotation with the handle shaft 39. The handle shaft 39 has on its free end an annular retainer plate 42 which is held slidably against the bottom of the counterbore 37. Thus, the handle shaft 39 is axially immovable or retained against removal once mounted in the casing 35. The casing 35 has a pair of upper and lower attachment flanges (not shown).

Another annular plate 43 is attached to the end of the casing 35 at the outer end of the counterbore 37, the annular plate 43 supporting thereon a sleeve 44 directed away from and extending coaxially with the central bore 36. The sleeve 44 has on its free end a wall 45 with a flanged edge 46 bounding a central square aperture 47. The driver torque bar 41 extends through the aperture 47, and has on the opposite free end a driver 48 having a flange 49 that defines a square recess 50. The square recess 50 opens away from the driver torque bar 41 and is substantially coextensive in cross-section with the shaft 18. The driver 48 has a square outer contour that can provide a sliding fit between the driver 48 and the flanged edge 46 of the end wall 45. Thus, the driver 48 is slidable into and out of the central aperture 47 in the direction of the axis of the torque bar 41, but is retained against rotation when positioned in the aperture 47.

A retainer flange 51 is fixed to the torque bar 41 and confined within the unit 12 to capture the torque bar 41 in the unit 12. A compression coil spring 52 is disposed around the torque bar 41, the spring 52 acting between the flanged edge 46 and the retainer flange 51 to normally bias the torque bar 41 away from the shaft 18, or the driver 48 into engagement with the flanged edge 46 that serves as fixed engaging means.

To shift the driver torque bar 41 axially toward the shaft 18, a push button 53 is housed in the handle 38 in coaxial relation with the torque bar 41, the push button 53 having a flange 54 trapped in a bore 55 in the handle 38 by means of a rim 56. The push button 53 is hollow and contains a compression coil spring 57 acting between the bottom of the hollow push button 53 and the end of the torque bar 41 projecting into the bore 55. The spring 57 normally biases the push button 53 away from the torque bar 41 into engagement with the rim 56. The spring 57 also serves to partially counteract the biasing force from the spring 52, thereby keeping the driver torque bar 41 in an equilibrated position in which the driver 48 engages the flanged edge 46 of the end wall 45. A key-actuated cylinder lock 58 is mounted in the handle 38 and has a retractable stop 59 which upon actuation of the lock 58 projects into the bore 55 for locking engagement with the flange 54 of the push button 53 to arrest its movement toward the driver torque bar 41.

Another bolt-driving unit 60 having a thumb turn 61 may also be provided on the stile 13, the unit 60 having a driver torque bar or spindle 62 with a free end so shaped as to fit over the end 21 of the shaft 18 for driving engagement therewith. For manipulation of the bolt-driving unit 60, the thumb turn 61 is pushed toward the stile 13 to cause the free end of the bar 62 to engage the end 21 of the shaft 18. The thumb turn 61 is further pushed to displace the shaft 18 axially toward the unit 12 until the flanges 22, 23 on the shaft 18 disengage from the walls 15, 16, respectively. Then, the thumb turn 61 can be turned to actuate the latch bolt 19 independently of the other bolt-driving unit 12.

The stile 13 includes a pair of spaced plates 63, 64 having a pair of attachment openings 65, 66 respectively, and a side plate 67 interconnecting the spaced plate 63, 64 and having an attachment opening 68. When the window sash or door is closed, the side plate 67 faces a side jamb (not shown) that partly defines an opening in which the window sash or door is mounted. The side jamb has a recess into which the latch bolt 19 can project for locking the window sash or door.

For assembling the latch assembly 10, the bolt unit 11 is first inserted in the opening 68 in the side plate 67 until the attachment flanges 32, 33 are held against the side plate 67. The attachment flanges 32, 33 are secured to the side plate 67 by means of screws (not shown) extending through the attachment screw holes into the side plate 67. Then, the bolt-driving units 12, 60 are installed on the stile 13, with the sleeve 44 inserted in the opening 65 and the sleeve 69 of the unit 60 in the opening 66. The units 12, 60 are fixed to the stile 13 by means of screws (not shown).

The attachment openings 65, 66 are in mutual registry such that the bolt-driving units 12, 60 upon installation have their driver torque bars 41, 62 aligned with each other and with the shaft 18 of the bolt unit 11 that has been mounted in place.

Usually, the bolt-driving unit 12 is mounted on the inner side of the door or sash, and the bolt-driving unit 60 on the outer side thereof. For normal latching or unlatching operation, the cylinder lock 58 is key-operated to withdraw the stop 59 from the bore 55, and the push button 53 is pushed into end-to-end engagement with the torque bar 41. The push button 53 is further pushed to allow the driver 48 to move out of engagement with the edge 46 into engagement with the end 20 of the shaft 18 against the force from the springs 52, 57. The button 53 is still further pushed to displace the shaft 18 axially toward the unit 60 until the flanges 22, 23 disengage from the walls 15, 16, respectively, against the force from the springs 31, 52 and 57. Then, while the push button 53 is pressed, the handle 38 is pivoted for 90° angular movement to actuate the latch bolt 19. After actuation of the latch bolt 19, the push button 53 is released to thereby allow the driver torque bar 41 to return under the bias of the spring 52 to its equilibrated position, and the shaft 18 to return under the bias of the spring 31, whereupon the flanges 22, 23 engage the walls 15, 16, respectively, again, and the driver 48 engages the sleeve edge 46 again. Thus, manipulation of the operator handle 38 is prevented unless the push button 53 is actuated. Further, the latch bolt 19 is retained against pivotal movement from its latched or unlatched position. When it is required to lock or unlock the window sash or door from the outside thereof as in case of emergency, the knob 61 is pushed as it is turned 90°, in the manner described, to operate the latch bolt 19.

Unitized for compactness, the bolt unit 11 and the bolt-driving unit 12 can be installed separately with maximum ease, and no special machining other than drilling is needed on the frame member 13.

Although various minor modifications may be suggested by those versed in the art, it should be understood that I wish to embody within the scope of the patent warranted hereon, all such embodiments as reasonably and properly come within the scope of my contribution to the art.

What I claim is:

1. A latch assembly for use on a closure frame member, comprising:

(a) a support frame having means by which it may be attached to the closure frame member;

(b) a shaft mounted in said support frame and rotatable about a longitudinal axis thereof;

(c) a latch bolt having means in one end thereof coupled with said shaft for effecting corotation therewith, said latch bolt extending radially from said shaft, said latch bolt being angularly movable about said axis between a first position in which said bolt is retracted within said support frame and a second position in which said bolt has the opposite end projecting outwardly from said support frame;

(d) a casing having means by which it may be attached to the closure frame member, said casing having a bore and fixed engaging means carried thereon;

(e) a handle having a cylinder shaft rotatably disposed in said bore;

(f) a driver torque bar having one end mounted coaxially in said cylinder shaft and corotatable therewith and axially movable therein, said driver torque bar having a driver fixed on its inner ends, said driver being normally held in an axially fixed position in response to said driver's being engaged with said fixed engaging means, and said driver being shiftable out of engagement with said fixed engaging means into rotational driving engagement with said first-named shaft in response to axial movement of said driver torque bar toward said shaft; and (g) means in said handle for enabling pushing said driver torque bar axially for engaging said driver with said first-named shaft.

2. A latch assembly according to claim 1, said pushing means comprising a push button retained in said handle coaxial with said torque bar, said push button being movable along the axis of said torque bar and upon depression, being held in end-to-end engagement with said torque bar, and a spring acting between said torque bar and said push button to normally bias them apart.

3. A latch assembly according to claim 1, said first-named shaft having further engaging means normally in engagement with said support frame by which said shaft is retained against rotation.

4. A latch assembly according to claim 1, said first-named shaft and driver being of square cross-section, and said driver having a square recess in which one end of said shaft can fit.

5. A latch assembly according to claim 1, further including spring means around said driver torque bar, said spring means normally urging said driver into engagement with said fixed engaging means.

6. A latch assembly according to claim 5, said casing including a sleeve having said fixed engaging means on one end, said driver torque bar having a fixed retainer flange, and said spring means comprising a compression coil spring disposed between said fixed engaging means and said fixed retainer flange.

7. A latch assembly according to claim 6, said sleeve having an end wall on said one end, and said fixed engaging means comprising an edge of said end wall defining a square opening in which said driver is slidably fitted.

8. A latch assembly according to claim 3, said support frame including a pair of spaced walls and an end wall interconnecting said spaced walls, said spaced walls having a pair of aligned square holes through which said shaft extends, and said engaging means comprising a pair of spaced square flanges on said shaft which slidably fit in said holes, respectively.

9. A latch assembly according to claim 8, said latch bolt having a square opening through said one end, said means in said latch bolt comprising a pair of square plates slidably disposed within said square opening in said latch bolt, and there being a spring disposed around said shaft and normally biasing said plates apart into engagement with said spaced walls.

10. A latch assembly according to claim 8, further including a spring acting between said end wall and said latch bolt for maintaining said latch bolt in one of said first and second positions.

11. A latch assembly according to claim 1, further including means retained in said handle for pushing said driver torque bar axially toward said shaft.

* * * * *